US012103804B2

(12) United States Patent
Iioka et al.

(10) Patent No.: US 12,103,804 B2
(45) Date of Patent: Oct. 1, 2024

(54) SHEET FEEDING APPARATUS

(71) Applicant: RISO KAGAKU CORPORATION, Tokyo (JP)

(72) Inventors: Yuzuru Iioka, Ibaraki (JP); Ryosuke Miyachi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 358 days.

(21) Appl. No.: 17/551,802

(22) Filed: Dec. 15, 2021

(65) Prior Publication Data

US 2022/0194723 A1 Jun. 23, 2022

(30) Foreign Application Priority Data

Dec. 23, 2020 (JP) ..... 2020-213402
Oct. 22, 2021 (JP) ..... 2021-173239

(51) Int. Cl.
*B65H 3/48* (2006.01)
*B65H 1/18* (2006.01)
*B65H 7/14* (2006.01)

(52) U.S. Cl.
CPC ..... *B65H 3/48* (2013.01); *B65H 1/18* (2013.01); *B65H 7/14* (2013.01); *B65H 2301/42324* (2013.01); *B65H 2553/414* (2013.01); *B65H 2801/03* (2013.01)

(58) Field of Classification Search
CPC ..... B65H 3/48; B65H 1/18; B65H 7/14; B65H 2301/42324; B65H 2553/414; B65H 2801/03
See application file for complete search history.

(56) References Cited

U.S. PATENT DOCUMENTS

2007/0228639 A1* 10/2007 Matsumoto ..... B65H 1/14 271/97
2007/0262513 A1* 11/2007 Fukusaka ..... B65H 3/48 271/98
2008/0036134 A1* 2/2008 Matsumoto ..... B65H 3/48 271/4.03
2020/0002114 A1* 1/2020 Matsuda ..... B65H 7/06

FOREIGN PATENT DOCUMENTS

JP 2019-147687 9/2019

* cited by examiner

*Primary Examiner* — Thomas A Morrison
(74) *Attorney, Agent, or Firm* — Greenblum & Bernstein, P.L.C.

(57) ABSTRACT

A controller controls a floating unit and a conveyor to convey a sheet to a supply destination, and performs a following control of acquiring a detection value of a detector which detects an output signal acquired due to an input to a side of a sheet stack, during floating of sheets floated by the floating unit each time a sheet is conveyed by the conveyor and lifting a stacking tray upon the acquired detection value being less than a threshold value. The controller controls the floating unit and the conveyor to perform a feeding retry upon an occurrence of empty feeding in the conveyor, and determines the threshold value such that a target position for a height position of an upper surface of the sheet stack in the following control is a position where empty feeding is more likely to occur than multiple sheet feeding in the conveyor.

12 Claims, 8 Drawing Sheets

SHEET FEEDING APPARATUS

CROSS REFERENCE TO RELATED APPLICATION

This application is based upon and claims the benefit of priority from the prior Japanese Patent Application Nos. 2020-213402 filed on Dec. 23, 2020 and 2021-173239 filed on Oct. 22, 2021, the entire contents of which are incorporated herein by reference.

BACKGROUND

1. Technical Field

The disclosure relates to a sheet feeding apparatus which feeds sheets.

2. Related Art

Japanese Patent Application Publication No. 2019-147687 discloses, as a sheet feeding apparatus which feeds sheets, a paper feeding apparatus which blows air to a sheet stack stacked on a sheet feed tray to float sheets, conveys a top (topmost) sheet of the floated sheets while sucking the top sheet by means of a suction conveyance means, and supplies the top sheet to a printer.

The paper feeding apparatus above performs following control of lifting a sheet feed tray in response to a decrease in sheets on the sheet feed tray to maintain the height position of the upper surface of the sheet stack on the sheet feed tray at a target position.

SUMMARY

In the paper feeding apparatus above, multiple sheet feeding or empty feeding may occur. Multiple sheet feeding means that plural sheets on top of one another are sucked and conveyed by the suction conveyance means. Empty feeding means that no sheet is sucked by the suction conveyance means, and thereby no sheet is conveyed.

The higher the height position of the upper surface of the sheet stack on the sheet feed tray becomes, the more multiple sheet feeding is likely to occur. The lower the height position of the upper surface of the sheet stack on the sheet feed tray becomes, the more empty feeding is likely to occur. The target position for the upper surface of the sheet stack in the following control above is set to a position where multiple sheet feeding and empty feeding are equally not likely to occur.

When empty feeding has occurred, it is possible to continue a series of sheet feeding operations and a printing operation at the printer as the sheet feed destination, by a sheet feeding retry (by retrying sheet feeding) with only a little wasted time for the sheet feeding of one sheet. That is, empty feeding can be remedied by a sheet feeding retry.

In contrast, when multiple sheet feeding has occurred, sheets subjected to multiple sheet feeding need to be returned to the sheet feed tray and then sheet feeding needs to be performed again for example, in order to continue a series of sheet feeding operations and a printing operation at the printer as the sheet feed destination. This requires complex mechanisms and control. Thus, multiple sheet feeding realistically cannot be remedied by a sheet feeding retry.

As described above, since the target position for the upper surface of the sheet stack in the following control above is set to the position where multiple sheet feeding and empty feeding are equally not likely to occur, multiple sheet feeding occurs at the same frequency as empty feeding. Since multiple sheet feeding cannot be remedied by a sheet feeding retry, the occurrence of multiple sheet feeding leads to a sheet feeding error and a series of sheet feeding operations is stopped. A sheet feeding error causes labor for a user to resolve the error. A sheet feeding error also causes the printing operation at the printer as the sheet feed destination to be stopped, resulting in a reduction in the productivity of printing.

The disclosure is directed to a sheet feeding apparatus which can reduce sheet feeding errors.

A sheet feeding apparatus in accordance with some embodiments includes: a stacking tray on which a sheet stack is stacked and which is capable of lifting and lowering; a floating unit configured to blow air to the sheet stack to float sheets of the sheet stack; a conveyor configured to convey a top sheet of sheets floated by the floating unit, to a supply destination; a detector configured to detect an output signal acquired due to an input to a side of the sheet stack; and a controller configured to control the floating unit and the conveyor to convey a sheet to the supply destination, the controller being configured to perform a following control of acquiring a detection value of the detector during floating of sheets floated by the floating unit each time a sheet is conveyed by the conveyor and lifting the stacking tray upon the acquired detection value being less than a threshold value. The controller is configured to: upon an occurrence of empty feeding in the conveyor, control the floating unit and the conveyor to perform a feeding retry of performing sheet conveyance to the supply destination again; and determine the threshold value such that a target position for a height position of an upper surface of the sheet stack in the following control is a position where empty feeding is more likely to occur than multiple sheet feeding in the conveyor.

A sheet feeding apparatus in accordance with some embodiments includes: a stacking tray on which a sheet stack is stacked and which is capable of lifting and lowering; a floating unit configured to blow air to the sheet stack to float sheets of the sheet stack; a conveyor configured to suck and convey a top sheet of sheets floated by the floating unit, to a supply destination; and a controller configured to control the floating unit and the conveyor to convey a sheet to the supply destination, the controller being configured to perform a following control of lifting the stacking tray in response to a decrease in sheets on the stacking tray. The controller is configured to: upon an occurrence of empty feeding in the conveyor, control the floating unit and the conveyor to perform a feeding retry of performing sheet conveyance to the supply destination again; and control the conveyor such that a sheet suction force of the conveyor is a suction force with which empty feeding is more likely to occur than multiple sheet feeding in the conveyor when a height position of an upper surface of the sheet stack is at a target position in the following control.

According to the aforementioned configurations, it is possible to reduce sheet feeding errors.

DETAILED DESCRIPTION

Figure 1:
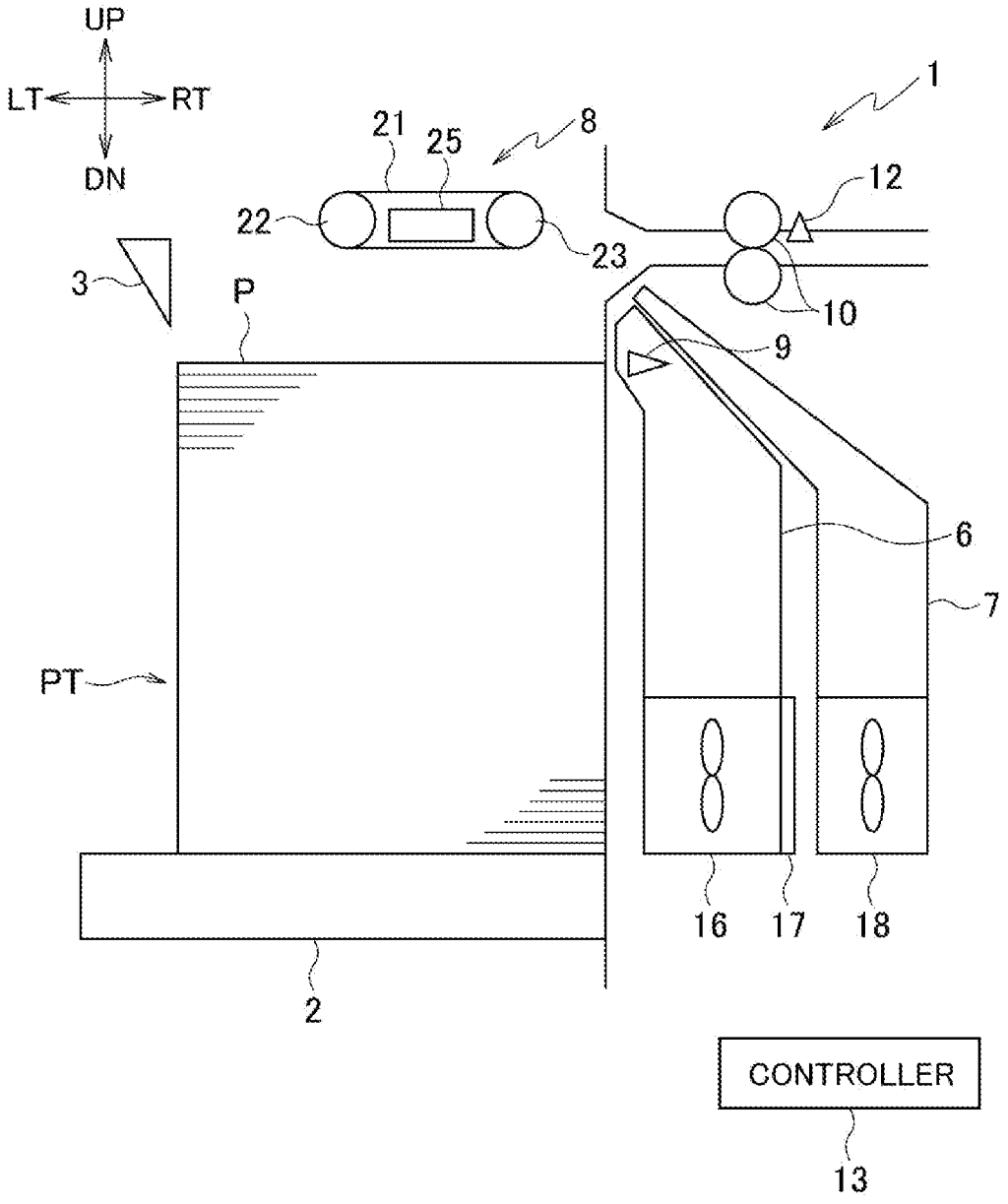
FIG. 1 is a schematic configuration diagram of a paper feeding apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from that in reality.

First Embodiment

Figure 2:
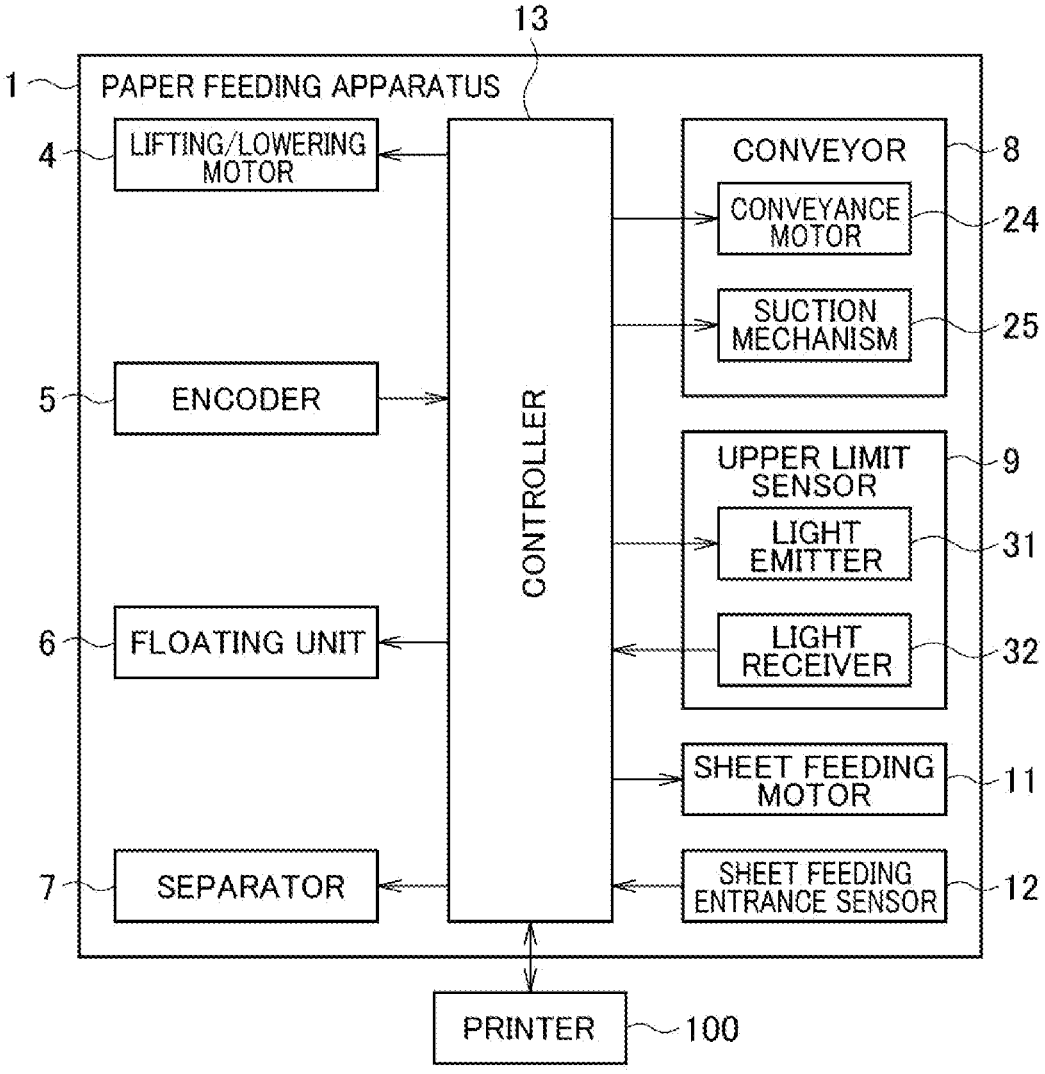
FIG. 2 is a control block diagram of the paper feeding apparatus illustrated in FIG. 1.
Figure 3:
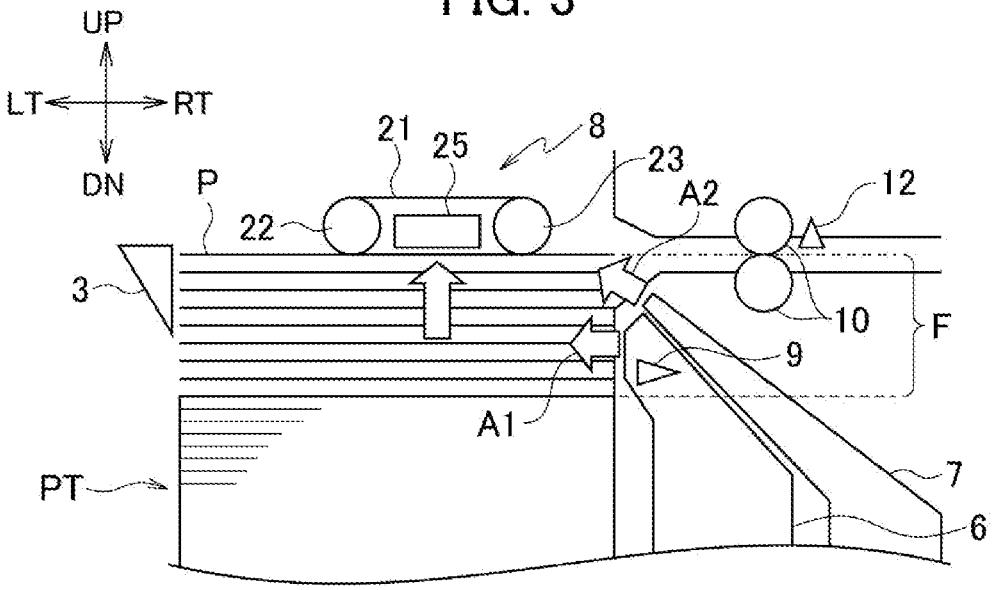
FIG. 3 is a view illustrating a floating state of plural sheets.
Figure 4:
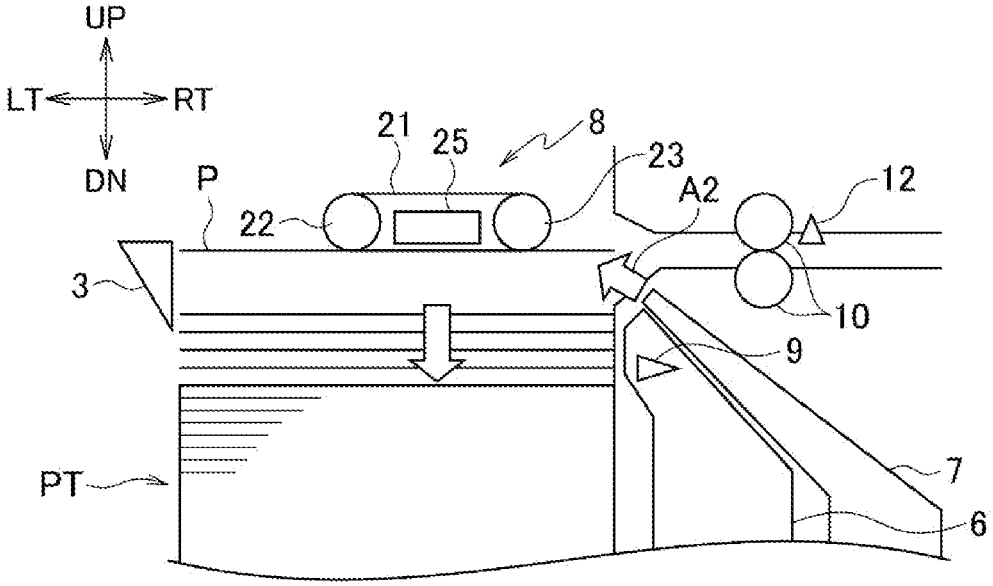
FIG. 4 is a view illustrating the second and subsequent sheets falling from the top sheet of sheets that are floated.

FIG. 1 is a schematic configuration diagram of a paper feeding apparatus 1 according to a first embodiment. FIG. 2 is a control block diagram of the paper feeding apparatus 1 illustrated in FIG. 1. In the following description, right and left in the page space of FIG. 1 is referred to as the right-left direction and up and down is referred to as the up-down direction. In FIGS. 1, 3, and 4, the directions of right, left, up, and down are denoted by RT, LT, UP, and DN, respectively.

As illustrated in FIGS. 1 and 2, the paper feeding apparatus (sheet feeding apparatus) 1 according to the first embodiment includes a sheet feed tray (stacking tray) 2, an end fence 3, a lifting/lowering motor 4, an encoder 5, a floating unit 6, a separator 7, a conveyor 8, an upper limit sensor (detector) 9, a pair of sheet feeding rollers 10, a sheet feeding motor 11, a sheet feeding entrance sensor 12, and a controller 13.

The paper feeding apparatus 1 is an apparatus which feeds (supplies) a sheet (paper) P to a printer 100 as the sheet supply destination (supply destination). The direction from the left toward the right in FIG. 1 is the conveyance direction of a sheet P conveyed by the conveyor 8 in a sheet feeding operation (sheet supplying operation). Upstream and downstream in the following description mean the upstream and the downstream in the conveyance direction of the sheet P conveyed by the conveyor 8.

The sheet feed tray 2 is a tray on which sheets P to be used in printing are stacked. The sheet feed tray 2 is capable of lifting and lowering.

The end fence 3 is a member which regulates the position of an upstream end (left end) of a sheet(s) P on the sheet feed tray 2.

The lifting/lowering motor 4 lifts and lowers the sheet feed tray 2.

The encoder 5 outputs a pulse signal for each prescribed rotation angle of a rotation shaft of the lifting/lowering motor 4.

The floating unit 6 blows air toward the side of a sheet stack (paper stack) PT consisting of plural sheets P stacked on top of one another on the sheet feed tray 2, from a downstream position lateral to the side of the sheet stack PT, and floats plural sheets P of the upper portion of the sheet stack PT. The floating unit 6 includes a floating fan 16 and a shutter 17.

The floating fan 16 generates a float air flow A1 (see FIG. 3) for floating sheets P of the sheet stack PT on the sheet feed tray 2.

The shutter 17 switches the blowing of the float air flow A1 to the sheet stack PT between on and off.

Note that another two floating units 6 may be provided facing each other with the sheet stack PT on the sheet feed tray 2 interposed therebetween in the width direction perpendicular to the conveyance direction of a sheet P.

The separator 7 separates the top sheet P floated by the floating unit 6 and sucked on the conveyor 8, from the second and subsequent sheets P from the top. The separator 7 includes a separating fan 18.

The separating fan 18 generates a separation air flow A2 (see FIG. 3) which is air blown to between the top sheet P floated by the floating unit 6 and sucked on the conveyor 8 and the second sheet P from the top to separate the top sheet P from the second and subsequent sheets P from the top.

Note that another two separators 7 may be provided facing each other with the sheet stack PT on the sheet feed tray 2 interposed therebetween in the width direction of a sheet P.

The conveyor 8 sucks, by air suction, the top sheet P among plural sheets P floated by the floating unit 6 and conveys the sucked top sheet P. The conveyor 8 includes a conveyance belt 21, a drive roller 22, a driven roller 23, a conveyance motor 24, and a suction mechanism 25.

The conveyance belt 21 is a loop belt bridged between the drive roller 22 and the driven roller 23. The conveyance belt 21 has belt holes (not illustrated) formed over the whole circumference of the conveyance belt 21. The conveyance belt 21 sucks and holds a sheet P with a suction force generated at the belt holes by the driving of the suction mechanism 25. A sheet P is conveyed by rotation (endless movement) of the conveyance belt 21 by the driving of the drive roller 22 with the sheet P sucked and held on the conveyance belt 21.

The drive roller 22 rotates (endlessly moves) the conveyance belt 21.

The driven roller 23 supports the conveyance belt 21 together with the drive roller 22. The driven roller 23 rotates to follow the rotating conveyance belt 21.

The conveyance motor 24 rotates the drive roller 22.

The suction mechanism 25 causes a sheet P to be sucked onto the conveyance belt 21 by sucking air through the belt holes of the conveyance belt 21. The suction mechanism 25 includes a fan (not illustrated) which sucks air through the belt holes of the conveyance belt 21.

The upper limit sensor 9 monitors the downstream (right side) edge surfaces of sheets P stacked on the sheet feed tray 2. The upper limit sensor 9 is arranged downstream of the sheet feed tray 2 and at a height position where the upper limit sensor 9 is able to detect sheets P being floated within a float region F (see FIG. 3). The float region F is a region in the up-down direction where the floating unit 6 floats sheets P. The upper limit sensor 9 is a reflective photosensor and includes a light emitter 31 and a light receiver 32.

The light emitter 31 emits light from the right position lateral to the side of the sheet stack PT on the sheet feed tray 2, to the left (towards the sheet stack PT).

The light receiver 32 receives light from the left (from the sheet stack PT).

The pair of sheet feeding rollers 10 nip a sheet P conveyed by the conveyor 8 and convey the sheet P to the printer 100 arranged downstream of the paper feeding apparatus 1.

The sheet feeding motor 11 drives the pair of sheet feeding rollers 10.

The sheet feeding entrance sensor 12 detects a sheet P that is being conveyed, in the downstream vicinity of the pair of sheet feeding rollers 10.

The controller 13 controls the whole processing of the paper feeding apparatus 1. The controller 13 includes a CPU, RAM, ROM, HDD, and the like.

The controller 13 controls the floating unit 6 and the conveyor 8 to float sheets P of the upper portion of the sheet stack PT on the sheet feed tray 2, suck the top sheet P onto the conveyance belt 21, and convey the top sheet P to the printer 100.

Upon empty feeding of a sheet P in the conveyor 8 having occurred, the controller 13 controls the floating unit 6 and the conveyor 8 to perform (repeat) a sheet feeding retry (feeding retry) until the number of occurrences of consecutive empty feeding reaches a prescribed upper limit consecutive number (prescribed number) R described later. Each sheet feeding retry is processing of performing the conveyance of a sheet P to the printer 100 again.

The controller 13, during a sheet feeding operation, acquires an amount of received light (a sensor value) at the light receiver 32 during the floating of sheets P floated by the floating unit 6 each time a sheet P is conveyed by the conveyor 8, and performs following control of lifting the sheet feed tray 2 upon the acquired amount of received light being less than a following threshold value (threshold value). In the following control, the sheet feed tray 2 is lifted in response to a decrease in the remaining sheets P on the sheet feed tray 2 due to sheet feeding, thereby maintaining a height position of the upper surface of the sheet stack PT on the sheet feed tray 2 at a target position.

The controller 13 sets (determines) the following threshold value such that the target position for the height position of the upper surface of the sheet stack ST in the following control during a sheet feeding operation becomes a position where empty feeding of a sheet P is more likely to occur than multiple sheet feeding of sheets P in the conveyor 8.

Note that a sensor value (each sensor value) during the floating of sheets P floated by the floating unit 6 is an amount of received light of reflected light from the edge surfaces of sheets P being floated within the detection range of the upper limit sensor 9. Thus, a sensor value during the floating of sheets P increases commensurate with an increase in the number of sheets P being floated within the detection range of the upper limit sensor 9.

The number of sheets P which are capable of being floated by air blowing by means of the floating unit 6 is the number of sheets P which are present within the float region F. Thus, the number of sheets P floated by air blowing by means of the floating unit 6 decreases commensurate with an decrease in the height position of the top sheet P (the upper surface of the sheet stack PT) on the sheet feed tray 2 with sheets P on the sheet feed tray 2 not being floated.

For this reason, a sensor value (each sensor value) acquired during the floating of sheets P can be used as pseudo information indicating the height position of the upper surface of the sheet stack PT on the sheet feed tray 2 for the case where sheets P on the sheet feed tray 2 are not floated. If the height position of the sheet feed tray 2 does not change, the number of floated sheets P becomes less as sheet feeding progresses and thus sensor values show a declining trend.

Thus, the paper feeding apparatus 1, as described above, performs the following control during a sheet feeding operation by using sensor values acquired during the floating of sheets P.

Next, processing of determining the following threshold value and the following control in the paper feeding apparatus 1 will be described.

Determination of the following threshold value is performed after the start of a series of sheet feeding operations. Here, an explanation is provided with the assumption that empty feeding and multiple sheet feeding of sheets P in the conveyor 8 do not occur.

In response to an instruction to start sheet feeding, the controller 13 starts lifting the sheet feed tray 2 from a state where the upper surface of the sheet stack PT on the sheet feed tray 2 is below the lower limit of the detection range of the upper limit sensor 9.

After the start of lifting the sheet feed tray 2, when the upper portion of the sheet stack PT on the sheet feed tray 2 enters into the detection range of the upper limit sensor 9, reflected light from the right side surface of the upper portion of the sheet stack PT starts to be received by the upper limit sensor 9. Then, the extent to which the sheet stack PT on the sheet feed tray 2 enters the detection range of the upper limit sensor 9 increases in accordance with the lifting of the sheet feed tray 2 and thus sensor values of the upper limit sensor 9 become greater.

Upon determining that a sensor value has reached a prescribed non-float threshold value, the controller 13 stops lifting the sheet feed tray 2. The non-float threshold value is set as the sensor value obtained when the height position of the upper surface of the sheet stack PT is at a prescribed sensor position within the detection range of the upper limit sensor 9. Thus, the sheet feed tray 2 is stopped with the height position of the upper surface of the sheet stack PT being at the sensor position by stopping the lifting of the sheet feed tray 2 when a sensor value reaches the non-float threshold value as described above.

Next, the controller 13 starts lifting or lowering the sheet feed tray 2 and then stops the sheet feed tray 2 when the upper surface of the sheet stack PT reaches a prescribed sheet feed start position. Accordingly, the height position of the upper surface of the sheet stack PT is set to the sheet feed start position. Note that the controller 13 determines whether the upper surface of the sheet stack PT reaches the sheet feed start position based on the number of pulses output from the encoder 5 from the timing of starting the lifting or lowering of the sheet feed tray 2.

The sheet feed start position is higher than the target position employed during the following control. Specifically, the sheet feed start position is higher than the target position by the thickness of the sheets P of the sum of the number of sampling exclusion sheets described later and half the number of sampling sheets described later.

As described above, the controller 13 sets (determines) the target position in the paper feeding apparatus 1 such that empty feeding of a sheet P is more likely to occur than multiple sheet feeding of sheets P in the conveyor 8. Specifically, the controller 13 sets the target position to a position lower by a prescribed offset amount than a proper position where multiple sheet feeding and empty feeding are equally not likely to occur. The prescribed offset amount is set based on experimentation and the like such that the target position becomes a position where an increase in empty feeding can be prevented and the occurrence of multiple sheet feeding can be prevented. The prescribed offset amount and the proper position depend on the sheet types (sheet thickness). The target position is set for each sheet type (sheet thickness).

Next, the controller 13 starts a sheet feeding operation. Specifically, the controller 13 opens the shutter 17 and starts the driving of the suction mechanism 25, the floating fan 16, and the separating fan 18. The controller 13 also controls the sheet feeding motor 11 to start the driving of the sheet feeding rollers 10.

After the start of the driving of the suction mechanism 25, the floating fan 16, and the separating fan 18, plural sheets P within the float region F are floated by the float air flow A1 and then the top sheet P is sucked onto the conveyance belt 21, as illustrated in FIG. 3.

Next, the controller 13 closes the shutter 17. Accordingly, the float air flow A1 is stopped. As a result, the top sheet P is separated from the second and subsequent sheets P from the top by the separation air flow A2, and then the second and subsequent sheets P fall, as illustrated in FIG. 4.

Next, upon receiving a sheet feeding signal from the printer 100, the controller 13 starts the driving of the conveyance motor 24 and controls the conveyor 8 to convey a sheet P. Accordingly, a sheet P is conveyed to the printer 100 by the conveyor 8 and the sheet feeding rollers 10. The controller 13 stops the conveyance motor 24 a prescribed drive period after the start of the driving of the conveyance motor 24.

Note that the sheet feeding signal is a signal by which the printer 100 instructs the paper feeding apparatus 1 to start the conveyance of a sheet P by means of the conveyor 8. The sheet feeding signal is transmitted from the printer 100 to the paper feeding apparatus 1 for each sheet to be fed by the paper feeding apparatus 1.

Next, the controller 13 opens the shutter 17 to float sheets P to feed the next sheet P.

By repetition of the above operations, each sheet P is sequentially fed from the paper feeding apparatus 1 to the printer 100.

Upon the number of fed sheets having reached the number of sampling exclusion sheets after the start of a sheet feeding operation, the controller 13 starts sampling the sensor values for determining the following threshold value.

Note that the number of sampling exclusion sheets is set beforehand as the number of fed sheets P for which sampling of sensor values for determining the following threshold value is not performed immediately after the start of a sheet feeding operation. As described later, the behavior of floated sheets P immediately after the start of a sheet feeding operation is unstable and thus the number of sampling exclusion sheets is set, thereby refraining from sampling sensor values until sheets P of the number of sampling exclusion sheets are fed. The behavior of floated sheets P varies depending on the sheet types (sheet thickness) and thus the number of sampling exclusion sheets is set depending on the sheet types (sheet thickness). The number of sampling exclusion sheets may be one or more.

Upon having started the sampling above, the controller 13 acquires a sensor value of the upper limit sensor 9 during the floating of sheets P floated for feeding the sheet P next to the last sheet P of the number of sampling exclusion sheets. Then, the controller 13 acquires a sensor value during the floating of sheets P each time a sheet P is conveyed (fed) by the conveyor 8. As each sensor value during the floating of sheets P, the controller 13 acquires a sensor value a prescribed time after the timing of opening the shutter 17, for example.

Upon having acquired sensor values of the number of sampling sheets, the controller 13 determines the following threshold value and starts the following control. Specifically, the controller 13 calculates the average value of the acquired sensor values of the number of sampling sheets and determines the calculated average value as the following threshold value.

Note that the number of sampling sheets is set beforehand as the number of fed sheets P for which sampling of sensor values for determining the following threshold value is to be performed. The number of sampling sheets may be set the same regardless of the sheet types and the like or may be set differently depending on the sheet types (sheet thickness).

The sampling period SP is a period for acquiring sensor values of the number of sampling sheets and is set such that the same number of sheets P are fed in the sampling period SP before and after the timing MT at which the height position of the upper surface of the sheet stack PT reaches the target position.

Upon having determined the following threshold value, the controller 13 starts the following control using the determined following threshold value. The height position of the sheet feed tray 2 is fixed (maintained) to the position set at the start of a sheet feeding operation, until the start of the following control.

Upon having started the following control, the controller 13 lifts the sheet feed tray 2 upon an acquired sensor value being less than the following threshold value each time a sheet P is fed.

Specifically, upon an acquired sensor value being less than the following threshold value, the controller 13 drives the lifting/lowering motor 4 to lift the sheet feed tray 2 for a prescribed drive period. When driving the lifting/lowering motor 4, the controller 13 controls a drive voltage of the lifting/lowering motor 4 depending on the difference between an acquired sensor value and the following threshold value.

Specifically, the controller 13 performs control so that the drive voltage of the lifting/lowering motor 4 increases to increase a lift amount of the sheet feed tray 2 as the difference between a sensor value and the following threshold value increases. As the difference between a sensor value and the following threshold value increases, the number of sheets P within the float region F decreases, and the height position of the upper surface of the sheet stack PT on the sheet feed tray 2 for the case where sheets P on the sheet feed tray 2 are not floated decreases. Thus, the controller 13 performs control so that the lift amount of the sheet feed tray 2 increases as the difference between a sensor value and the following threshold value increases. The relation between the difference between a sensor value and the following threshold value and the drive voltage of the lifting/lowering motor 4 is set beforehand based on experimentation and the like depending on the sheet types (sheet thickness) such that the height position of the upper surface of the sheet stack PT reaches the target position by lifting of the sheet feed tray 2.

Figure 5:
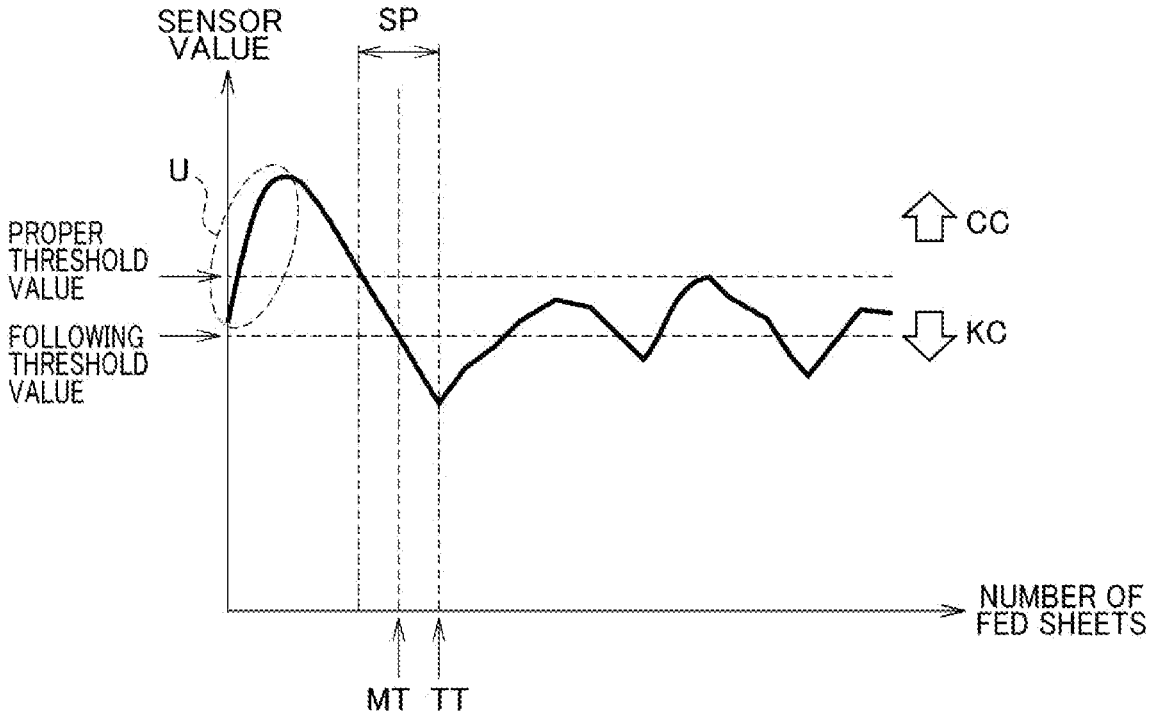
FIG. 5 is a diagram illustrating an example of the transition of a sensor value acquired during the floating of sheets for each fed sheet.

FIG. 5 illustrates an example of the transition of a sensor value acquired during the floating of sheets P for each sheet P fed in a sheet feeding operation.

In the state where the height position of the sheet feed tray 2 is fixed (maintained), the height position of the upper surface of the sheet stack PT becomes lower and the number of sheets P within the float region F decreases as sheet feeding progresses. Thus, the number of sheets P floated by the floating unit 6 decreases as the number of fed sheets P from the start of a sheet feeding operation increases. Thus, a sensor value acquired during the floating of sheets P for each fed sheet P becomes less as the number of fed sheets P from the start of the sheet feeding operation increases.

However, the behavior of floated sheets P immediately after the start of a sheet feeding operation tends to be unstable. For example, plural sheets P may be floated with the plural sheets P closely attached to each other because air has not entered well between the plural sheets P. A sensor value acquired in this state is less than a sensor value acquired in the state where all the floated sheets P are separated from each other. For this reason, as indicated by U in FIG. 5, sensor values immediately after the start of a sheet feeding operation tend to be unstable with sensor values being less than the estimated values and the like. Especially, a sensor value acquired at the time of feeding the first sheet P tends to be unstable.

Accordingly, as described above, in the paper feeding apparatus 1, the number of sampling exclusion sheets described above is set in order to avoid sampling sensor values immediately after the start of a sheet feeding operation.

In the paper feeding apparatus 1, as illustrated in FIG. 5, the sampling period SP is set including the timing MT at which the height position of the upper surface of the sheet stack PT becomes the target position. Moreover, as described above, the sampling period SP is a period for acquiring sensor values of the number of sampling sheets and is set such that the same number of sheets P are fed in the sampling period SP before and after the timing MT at which the height position of the upper surface of the sheet stack PT becomes the target position. In FIG. 5, the timing TT is the timing of starting the following control.

The proper threshold value illustrated in FIG. 5 is a following threshold value in the case, different from the embodiment of the disclosure, where following control of maintaining the height position of the upper surface of the sheet stack PT at the proper position described above is performed. That is, the proper threshold value is a value with which multiple sheet feeding and empty feeding are equally not likely to occur. When the following threshold value is greater than the proper threshold value (the arrow CC in FIG. 5), multiple sheet feeding is more likely to occur than empty feeding. When the following threshold value is less than the proper threshold value (the arrow KC in FIG. 5), empty feeding is more likely to occur than multiple sheet feeding. As described above, the target position is set to the position lower than the proper position in the embodiment, and thus the following threshold value is less than the proper threshold value and is a value with which empty feeding is more likely to occur than multiple sheet feeding.

Next, by referring to the flowcharts of FIGS. 6 and 7, operations of the paper feeding apparatus 1 in the case where empty feeding has occurred will be described.

Figure 6:
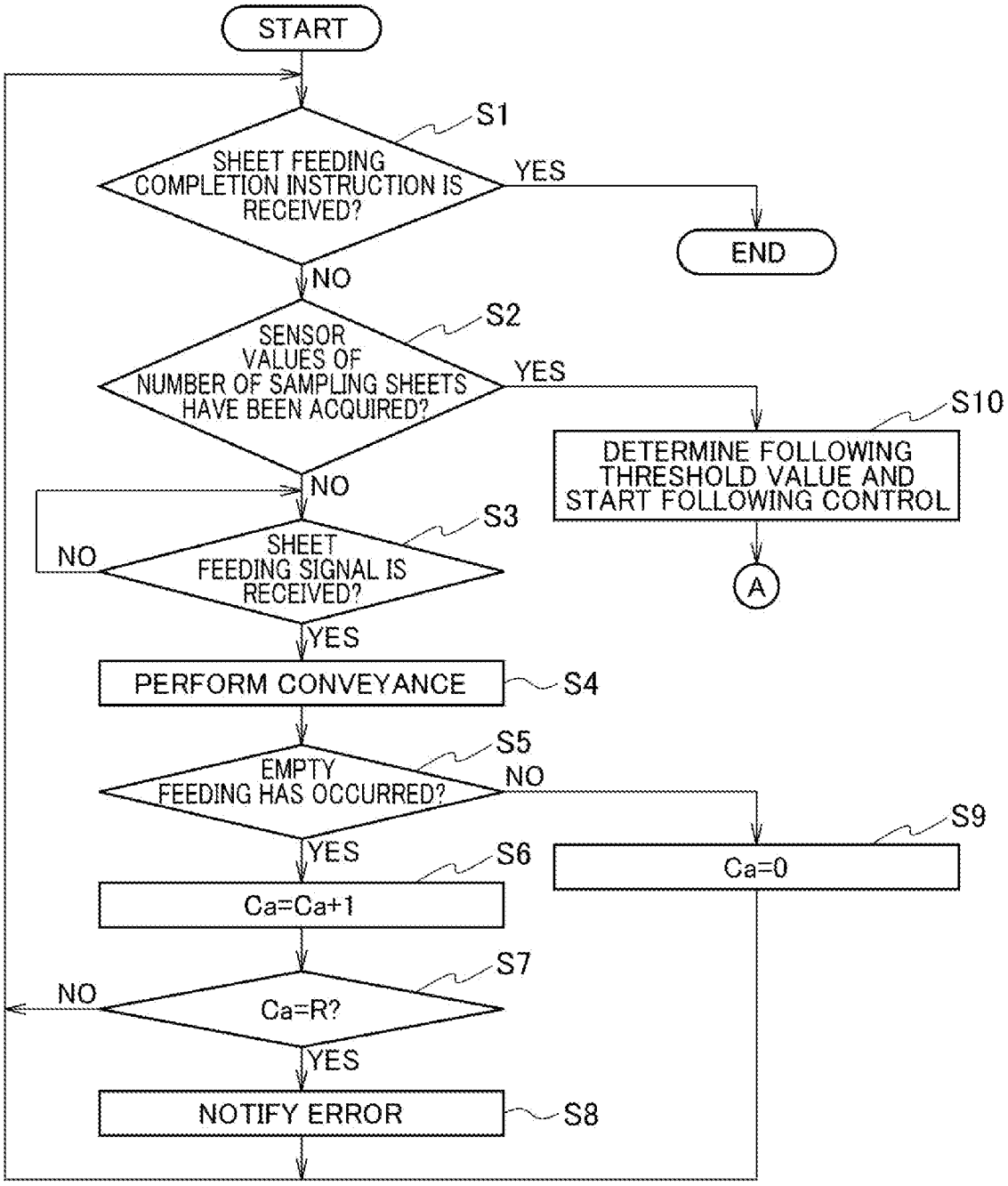
FIG. 6 is a flowchart explaining operations of the paper feeding apparatus in the case where empty feeding has occurred, according to the first embodiment.
Figure 7:
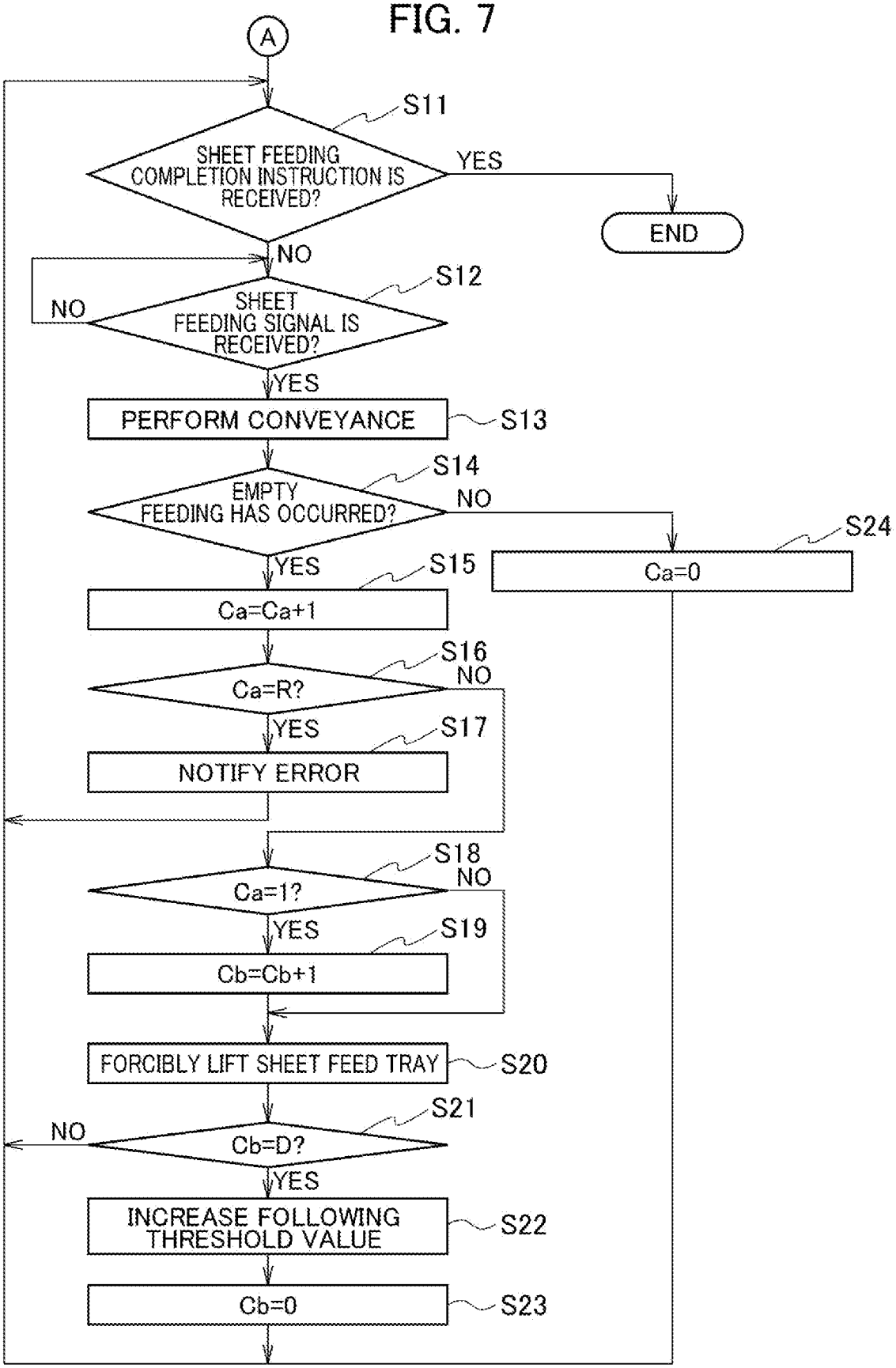
FIG. 7 is a flowchart explaining operations of the paper feeding apparatus in the case where empty feeding has occurred, according to the first embodiment.

The processing of the flowcharts of FIGS. 6 and 7 is started by the start of a sheet feeding operation.

In step S1 of FIG. 6, the controller 13 determines whether the controller 13 has received a sheet feeding completion instruction, from the printer 100. The sheet feeding completion instruction is transmitted in order that the printer 100 instructs the paper feeding apparatus 1 to complete sheet feeding. The sheet feeding completion instruction is an instruction transmitted by the printer 100 to the paper feeding apparatus 1 upon completion of sheet feeding of the number of sheets to be fed in a series of sheet feeding operations or upon the printer 100 having received an error notification from the paper feeding apparatus 1.

Upon determining that the controller 13 has received a sheet feeding completion instruction (step S1: YES), the controller 13 completes a series of sheet feeding operations.

Upon determining that the controller 13 has not received a sheet feeding completion instruction (step S1: NO), in step S2, the controller 13 determines whether sensor values of the number of sampling sheets described above have been acquired.

Upon determining that sensor values of the number of sampling sheets have not been acquired (step S2: NO), in step S3, the controller 13 determines whether the paper feeding apparatus 1 (the controller 13) has received a sheet feeding signal from the printer 100. Upon determining that the paper feeding apparatus 1 has not received a sheet feeding signal (step S3: NO), the controller 13 repeats step S3.

Upon determining that the controller 13 has received a sheet feeding signal (step S3: YES), in step S4, the controller 13 controls the conveyor 8 to convey a sheet P. At the time when the paper feeding apparatus 1 receives a sheet feeding signal, as described above, the top sheet P among plural sheets P floated by the floating unit 6 is being sucked onto the conveyance belt 21.

Next, in step S5, the controller 13 determines whether empty feeding of a sheet P in the conveyor 8 has occurred. The controller 13 determines that empty feeding has occurred upon the sheet feeding entrance sensor 12 having not detected a sheet P conveyed from the conveyor 8 within a prescribed time from the start of conveyance of a sheet P by the conveyor 8 in step S4.

Upon determining that empty feeding has occurred (step S5: YES), in step S6, the controller 13 adds 1 to a consecutive empty feeding count value Ca. The consecutive empty feeding count value Ca indicates the number of occurrences of consecutive empty feeding of a sheet P in the conveyor 8. The consecutive empty feeding count value Ca is set to 0 at the time of the start of a series of sheet feeding operations.

Next, in step S7, the controller 13 determines whether the consecutive empty feeding count value Ca has reached the prescribed upper limit consecutive number R (i.e. whether Ca=R). The prescribed upper limit consecutive number R is a number set as a criteria for the number of occurrences of consecutive empty feeding for determining whether to complete repetition of the sheet feeding retry and give an error notification due to empty feeding. The prescribed upper limit consecutive number R may be one occurrence or plural occurrences. The prescribed upper limit consecutive number R is set beforehand based on experimentation and the like.

Upon determining that the consecutive empty feeding count value Ca has not reached the prescribed upper limit consecutive number R (step S7: NO), the controller 13 returns to step S1.

In the paper feeding apparatus 1, upon empty feeding of a sheet P in the conveyor 8 having occurred before the following threshold value is determined after a series of sheet feeding operations is started, the controller 13 does not use a sensor value(s) sampled at the time of the occurrence of empty feeding, as a sensor value(s) for determining the following threshold value. That is, the controller 13 does not include a sensor value(s) sampled at the time of the occurrence of empty feeding, in the sensor values of the number of sampling sheets.

Thus, in the case where the controller 13 has determined "NO" in step S7 and returned to step S1, upon having not received a sheet feeding completion instruction (step S1: NO), the controller 13 determines in step S2 that sensor values of the number of sampling sheets have not been acquired (step S2: NO). In addition, upon having received a sheet feeding signal (step S3: YES), the controller 13 causes the conveyor 8 to convey a sheet P (step S4). At that time, the controller 13 causes the floating unit 6 to float plural sheets P of the sheet stack PT and suck the top sheet P onto the conveyance belt 21 by opening the shutter 17, and causes the conveyor 8 to convey the top sheet P. In this way, a sheet feeding retry is performed.

Upon determining in step S7 that the consecutive empty feeding count value Ca has reached the prescribed upper limit consecutive number R (step S7: YES), in step S8, the controller 13 transmits an error notification due to empty feeding to the printer 100. Thereafter, the controller 13 returns to step S1.

Receiving an error notification due to empty feeding, the printer 100 transmits a sheet feeding completion instruction to the paper feeding apparatus 1. Thus, in the case where the process has returned to step S1 from step S8, the controller 13 determines that the controller 13 has received a sheet feeding completion instruction (step S1: YES) and then completes a series of sheet feeding operations as a sheet feeding error.

Upon determining in step S5 that empty feeding has not occurred (step S5: NO), in step S9, the controller 13 clears the consecutive empty feeding count value Ca (i.e. sets Ca=0). Thereafter, the controller 13 returns to step S1.

Upon determining in step S2 that sensor values of the number of sampling sheets have been acquired (step S2: YES), in step S10, the controller 13 determines the following threshold value and starts the following control as described above. Thereafter, the controller 13 proceeds to step S11 of FIG. 7.

As described above, in the paper feeding apparatus 1, a sensor value(s) sampled at the time of the occurrence of empty feeding is not included in sensor values of the number of sampling sheets. Thus, upon completion of the acquisition of sensor values of the number of sampling sheets, the last sheet P of the number of sampling sheets has been conveyed without empty feeding. Accordingly, the consecutive empty feeding count value Ca is 0 when the following threshold value is determined and the following control is started in step S10.

The processing in steps S11 to S17 of FIG. 7 is the same as the processing in steps S1 and S3 to S8 of FIG. 6 described above.

Upon determining in step S16 that the consecutive empty feeding count value Ca has not reached the prescribed upper limit consecutive number R (step S16: NO), in step S18, the controller 13 determines whether the consecutive empty feeding count value Ca is 1.

Upon determining that the consecutive empty feeding count value Ca is 1 (step S18: YES), in step S19, the controller 13 adds 1 to an intermittent empty feeding count value Cb. Thereafter, the controller 13 proceeds to step S20.

The intermittent empty feeding count value Cb indicates the number of occurrences of intermittent empty feeding of a sheet P in the conveyor 8. The intermittent empty feeding count value Cb is set to 0 at the time of the start of a series of sheet feeding operations.

Upon determining in step S18 that the consecutive empty feeding count value Ca is not 1 (step S18: NO), the controller 13 skips step S19 and proceeds to step S20.

In step S20, the controller 13 forcibly lifts the sheet feed tray 2 by a prescribed lifting amount. The controller 13 is able to determine the prescribed lifting amount of the sheet feed tray 2 based on the number of pulses output from the encoder 5.

Forcibly lifting the sheet feed tray 2 in step S20 is performed separately from lifting the sheet feed tray 2 by the following control. Forcibly lifting the sheet feed tray 2 is performed in order to prevent the occurrence of consecutive empty feeding. The prescribed lifting amount for forcibly lifting the sheet feed tray 2 is set beforehand based on experimentation and the like, as a value with which the occurrence of consecutive empty feeding can be prevented.

Forcibly lifting the sheet feed tray 2 in step S20 means forcibly lifting the sheet feed tray 2 by the prescribed lifting amount upon empty feeding of a sheet P in the conveyor 8 having occurred during the following control.

Next, in step S21, the controller 13 determines whether the intermittent empty feeding count value Cb has reached a prescribed upper limit intermittent number (intermittent number) D (i.e. whether Cb=D). The prescribed upper limit intermittent number D is a number set as a criteria for the number of occurrences of intermittent empty feeding for determining whether to increase the following threshold value to prevent the occurrence of empty feeding. The prescribed upper limit intermittent number D is set to plural occurrences. The prescribed upper limit intermittent number D is set beforehand based on experimentation and the like.

Upon determining that the intermittent empty feeding count value Cb has not reached the prescribed upper limit intermittent number D (step S21: NO), the controller 13 returns to step S11.

In the case where the controller 13 has determined "NO" in step S21 and returned to step S11, upon having not received a sheet feeding completion instruction (step S11: NO) and having received a sheet feeding signal (step S12: YES), the controller 13 causes the conveyor 8 to convey a sheet P (step S13). At that time, the controller 13 causes the floating unit 6 to float plural sheets P of the sheet stack PT and suck the top sheet P onto the conveyance belt 21 by opening the shutter 17, and causes the conveyor 8 to convey the top sheet P. In this way, the sheet feeding retry is performed.

Upon determining in step S21 that the intermittent empty feeding count value Cb has reached the prescribed upper limit intermittent number D (step S21: YES), in step S22, the controller 13 increases the following threshold value by a prescribed amount. Accordingly, it is possible to reduce the occurrences of subsequent empty feeding. How much (the prescribed amount described above) the following threshold value should be increased by is set beforehand based on experimentation and the like, as a value with which the occurrences of empty feeding can be reduced.

Next, in step S23, the controller 13 clears the intermittent empty feeding count value Cb (i.e. sets Cb=0). Thereafter, the controller 13 returns to step S11.

Upon determining in step S14 that empty feeding has not occurred (step S14: NO), in step S24, the controller 13 clears the consecutive empty feeding count value Ca (i.e. sets Ca=0). Thereafter, the controller 13 returns to step S11.

Upon multiple sheet feeding of a sheet P in the conveyor 8 having occurred during a sheet feeding operation, the controller 13 transmits an error notification due to multiple sheet feeding to the printer 100. Thereafter, the controller 13 receives a sheet feeding completion instruction from the printer 100 and then completes a series of sheet feeding operations as a sheet feeding error.

Multiple sheet feeding of a sheet P in the conveyor 8 is detected by a multiple sheet feeding sensor (not illustrated) provided in the vicinity of the sheet feeding rollers 10, for example. The sheet feeding entrance sensor 12 may also function as the multiple sheet feeding sensor.

As explained above, in the paper feeding apparatus 1, the controller 13 sets (determines) the following threshold value such that the target position for the height position of the upper surface of the sheet stack ST in the following control becomes a position where empty feeding of a sheet P is more likely to occur than multiple sheet feeding of sheets P in the conveyor 8. Thus, it is possible to reduce the occurrences of multiple sheet feeding which cannot be remedied by a sheet feeding retry and result in a sheet feeding error. Although empty feeding becomes more likely to occur, the controller 13, upon empty feeding having occurred, performs (repeats) a sheet feeding retry until the number of occurrences of consecutive empty feeding reaches the prescribed upper limit consecutive number R. Thus, a sheet feeding error can be prevented even if empty feeding has occurred, by remedying empty feeding by means of a sheet feeding retry. As a result, sheet feeding errors can be reduced in the paper feeding apparatus 1.

Also in the paper feeding apparatus 1, upon the number of occurrences of consecutive empty feeding of a sheet P in the conveyor 8 (the consecutive empty feeding count value Ca) having reached the prescribed upper limit consecutive number R, the controller 13 completes a series of sheet feeding operations without performing a sheet feeding retry afterward. Thus, it is possible to prevent the unproductive repetition of empty feeding and a sheet feeding retry due to the setting of the following threshold value such that the target position becomes a position where empty feeding is more likely to occur than multiple sheet feeding. It is also possible to prevent the unproductive repetition of empty feeding and a sheet feeding retry due to the other causes (a sheet P becoming caught by a member in the apparatus and the like). It is possible to prevent the unproductive repetition of empty feeding and a sheet feeding retry also in the period from the start of a series of sheet feeding operations to the determination of the following threshold value and the start of the following control.

In the paper feeding apparatus 1, upon empty feeding of a sheet P in the conveyor 8 having occurred in the period from the start of a series of sheet feeding operations to determination of the following threshold value, the controller 13 does not use a sensor value(s) sampled at the time of the occurrence of empty feeding, as a sensor value(s) for determining the following threshold value. Thus, it is possible to prevent a decrease in the accuracy of the following threshold value even if empty feeding has occurred before determination of the following threshold value.

In the paper feeding apparatus 1, the controller 13 forcibly lifts the sheet feed tray 2 by the prescribed lifting amount upon empty feeding of a sheet P in the conveyor 8 having occurred during the following control. Thus, it is possible to prevent consecutive occurrences of empty feeding.

In the paper feeding apparatus 1, upon the number of occurrences of intermittent empty feeding of a sheet P in the conveyor 8 (the intermittent empty feeding count value Cb) having reached the prescribed upper limit intermittent number D during the following control, the controller 13 increases the following threshold value by the prescribed amount. Thus, it is possible to improve the situation, if confronted therewith, where empty feeding is likely to occur due to the following threshold value being set to a value that is too small.

Note that, upon determining that the intermittent empty feeding count value Cb has reached the prescribed upper limit intermittent number D, the controller 13 may increase the suction force applied to a sheet P by the conveyor 8 by a prescribed amount as with a fourth embodiment described later. Furthermore, upon determining that the intermittent empty feeding count value Cb has reached the prescribed upper limit intermittent number D, the controller 13 may combine the processing of increasing the following threshold value by the prescribed amount and the processing of increasing the suction force applied to a sheet P by the conveyor 8 by the prescribed amount. In the case where the processing of increasing the following threshold value by the prescribed amount and the processing of increasing the suction force applied to a sheet P by the conveyor 8 by the prescribed amount are combined, how much the following threshold value should be increased by and how much the suction force applied to a sheet P by the conveyor 8 should be increased by can be set beforehand based on experimentation and the like, for example, such that the occurrences of empty feeding can be reduced.

Second Embodiment

Next, a description will be given regarding a second embodiment in which parts of the operations of the paper feeding apparatus 1 of the first embodiment in the case where empty feeding has occurred are modified.

Figure 8:
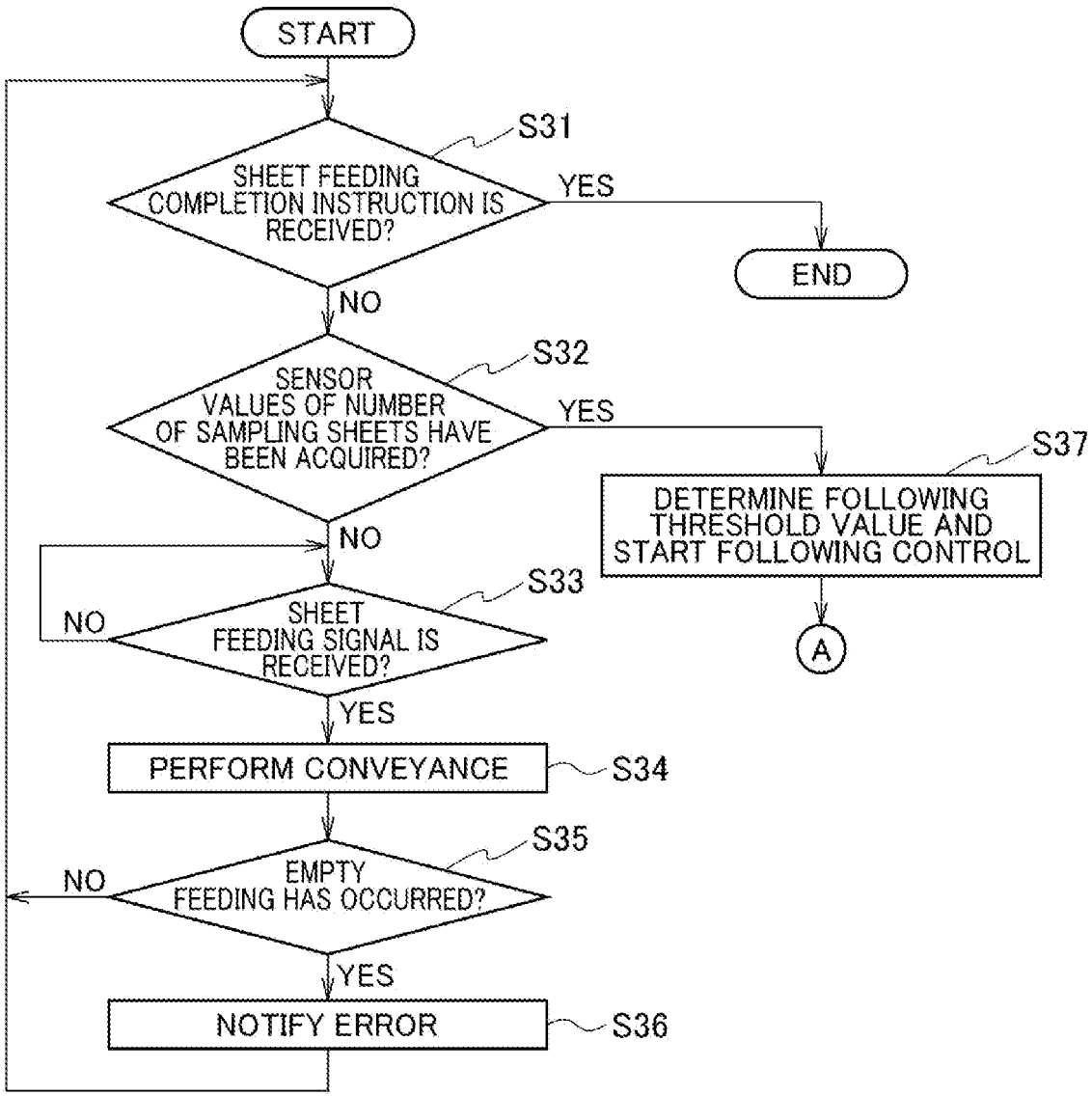
FIG. 8 is a flowchart explaining operations of the paper feeding apparatus in the case where empty feeding has occurred, according to a second embodiment.

FIG. 8 is a flowchart explaining operations of the paper feeding apparatus 1 in the case where empty feeding has occurred, according to the second embodiment.

The processing in steps S31 to S35 of FIG. 8 is the same as the processing in steps S1 to S5 of FIG. 6 described above.

Upon determining in step S35 that empty feeding has not occurred (step S35: NO), the controller 13 returns to step S31.

In the case where the controller 13 has determined "NO" in step S35 and returned to step S31, upon having not received a sheet feeding completion instruction (step S31: NO), having not acquired sensor values of the number of sampling sheets yet (step S32: NO), and having received a sheet feeding signal (step S33: YES), the controller 13 causes the conveyor 8 to convey a sheet P (step S34). At that time, the controller 13 causes the floating unit 6 to float plural sheets P of the sheet stack PT and suck the top sheet P onto the conveyance belt 21 by opening the shutter 17, and causes the conveyor 8 to convey the top sheet P. In this way, the sheet feeding retry is performed.

Upon determining that empty feeding has occurred (step S35: YES), in step S36, the controller 13 transmits an error notification due to empty feeding to the printer 100. Thereafter, the controller 13 returns to step S31.

Receiving an error notification due to empty feeding, the printer 100 transmits a sheet feeding completion instruction to the paper feeding apparatus 1. Thus, in the case where the process has returned to step S31 from step S36, the controller 13 determines that the controller 13 has received a sheet feeding completion instruction (step S31: YES) and then completes a series of sheet feeding operations as a sheet feeding error. Accordingly, upon empty feeding of a sheet P in the conveyor 8 having occurred in the period from the start of a series of sheet feeding operations to determination of the following threshold value, the controller 13 completes a series of sheet feeding operations as a sheet feeding error without performing a sheet feeding retry.

Upon determining in step S32 that sensor values of the number of sampling sheets have been acquired (step S32: YES), in step S37, the controller 13 determines the following threshold value and starts the following control as with step S10 of FIG. 6 described above. Thereafter, the controller 13 proceeds to step S11 of FIG. 7 to perform the subsequent processing.

As explained above, in the second embodiment, upon empty feeding of a sheet P in the conveyor 8 having occurred before determination of the following threshold value, the controller 13 completes a series of sheet feeding operations without performing a sheet feeding retry. Thus, it is possible to avoid determination of the following threshold value in the state where there are any underlying causes for allowing empty feeding to be likely to occur. Accordingly, it is possible to prevent the repetition of empty feeding and a sheet feeding retry in the state where a sheet feeding operation has been advanced, and prevent a sheet feeding error due to the consecutive empty feeding count value Ca reaching the prescribed upper limit consecutive number R. That is, by determining a sheet feeding error at an earlier stage after the start of a sheet feeding operation, a user can respond at an earlier stage.

Third Embodiment

Next, a description will be given regarding a third embodiment in which parts of the operations of the paper feeding apparatus 1 of the first embodiment in the case where empty feeding has occurred are modified.

Figure 9:
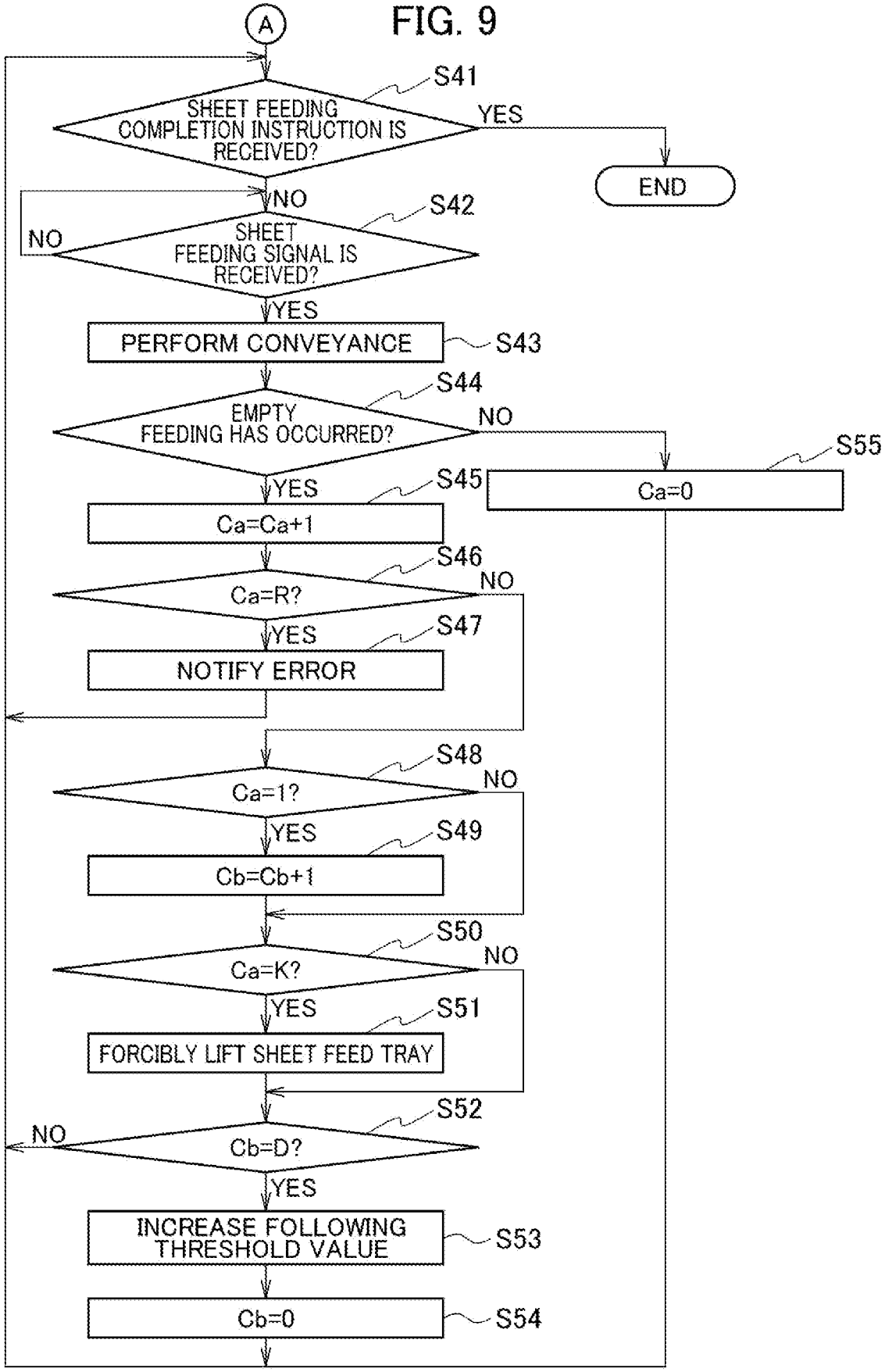
FIG. 9 is a flowchart explaining operations of the paper feeding apparatus in the case where empty feeding has occurred, according to a third embodiment.

FIG. 9 is a flowchart explaining operations of the paper feeding apparatus 1 in the case where empty feeding has occurred, according to the third embodiment.

In the third embodiment, upon a sheet feeding operation having been started, the processing of steps S1 to S10 of FIG. 6 described above is performed as with the first embodiment. In the third embodiment, the processing proceeds to step S41 of FIG. 9 after step S10 of FIG. 6. Alternatively, the processing of steps S31 to S37 of FIG. 8 explained in the second embodiment may be performed and the processing may proceed to step S41 of FIG. 9 after step S37 of FIG. 8.

The processing in steps S41 to S49 of FIG. 9 is the same as the processing in steps S11 to S19 of FIG. 7 described above.

In step S50 of FIG. 9, the controller 13 determines whether the consecutive empty feeding count value Ca has reached a prescribed consecutive number K (i.e. whether Ca=K). The prescribed consecutive number K is a number set as a criteria for the number of occurrences of consecutive empty feeding for determining whether to forcibly lift the sheet feed tray 2 in order to prevent the occurrence of empty feeding. The prescribed consecutive number K is set to plural occurrences. The prescribed consecutive number K is set beforehand based on experimentation and the like, as a value with which the excessive lifting of the sheet feed tray 2 can be avoided and the occurrence of empty feeding can be prevented. In the third embodiment, the prescribed upper limit consecutive number R is set greater than the prescribed consecutive number K.

Upon determining that the consecutive empty feeding count value Ca has reached the prescribed consecutive number K (step S50: YES), in step S51, the controller 13 forcibly lifts the sheet feed tray 2 by the prescribed lifting amount as with step S20 of FIG. 7 described above. Thereafter, the controller 13 proceeds to step S52.

Upon determining that the consecutive empty feeding count value Ca has not reached the prescribed consecutive number K (step S50: NO), the controller 13 skips step S51 and proceeds to step S52. Thus, the controller 13 does not forcibly lift the sheet feed tray 2 until empty feeding of a sheet P in the conveyor 8 during the following control has repeatedly occurred up to the prescribed consecutive number K.

The processing in steps S52 to S55 is the same as the processing in steps S21 to S24 of FIG. 7 described above.

As explained above, in the third embodiment, the controller 13 does not forcibly lift the sheet feed tray 2 until empty feeding of a sheet P in the conveyor 8 during the following control has repeatedly occurred up to the prescribed consecutive number K. Thus, an increased risk of the occurrences of multiple sheet feeding due to the excessive lifting of the sheet feed tray 2 can be prevented and the occurrence of empty feeding can be prevented.

Fourth Embodiment

Next, a fourth embodiment in which parts of the first embodiment are modified will be described.

In the fourth embodiment, the controller 13 controls the conveyor 8 such that the suction force applied to a sheet P by the conveyor 8 becomes a suction force with which empty feeding of a sheet P is more likely to occur than multiple sheet feeding of sheets P when the height position of the upper surface of the sheet stack ST is at the target position in the following control. Specifically, the controller 13 sets (determines) a suction air volume of the suction mechanism 25 of the conveyor 8 employed during a sheet feeding operation, to an air volume less than the proper air volume. The proper air volume is a suction air volume with which multiple sheet feeding and empty feeding are equally not likely to occur when the height position of the upper surface of the sheet stack ST is at the target position in the following control.

In the conveyor 8, if the height position of the upper surface of the sheet stack ST is maintained the same, the suction force applied to a sheet P on the conveyance belt 21 becomes less and a friction force between the conveyance belt 21 and a sheet P becomes less, as the suction air volume of the suction mechanism 25 becomes less. Thus, empty feeding of a sheet P becomes likely to occur.

In the fourth embodiment, the processing of determining the following threshold value and the following control are performed as with the first embodiment.

That is, in response to an instruction to start sheet feeding, the controller 13 adjusts the height position of the sheet feed tray 2 to set the upper surface of the sheet stack PT to the sheet feed start position which is higher than the target position by the thickness of sheets P of the sum of the number of sampling exclusion sheets and half the number of sampling sheets.

Next, the controller 13 starts a sheet feeding operation. At that time, the controller 13 sets (determines) the suction air volume of the suction mechanism 25 to an air volume less than the proper air volume described above and starts the driving of the suction mechanism 25. The suction air volume of the suction mechanism 25 is set, depending on the sheet types and the sheet sizes, to a suction air volume with which an increase in the occurrences of empty feeding can be prevented and the occurrences of multiple sheet feeding can be prevented during the following control. The suction air volume of the suction mechanism 25 depending on the sheet types and the sheet sizes is determined beforehand based on experimentation and the like.

Upon the number of fed sheets having reached the number of sampling exclusion sheets after the start of a sheet feeding operation, the controller 13 starts sampling the sensor values for determining the following threshold value. Upon having acquired sensor values of the number of sampling sheets, the controller 13 determines the following threshold value and starts the following control.

Upon having determined the following threshold value, the controller 13 starts the following control using the determined following threshold value. Upon having started the following control, the controller 13 lifts the sheet feed tray 2 upon an acquired sensor value being less than the following threshold value each time a sheet P is fed.

As described above, since the suction air volume of the suction mechanism 25 has been set to an air volume less than the proper air volume, a sheet feeding operation is performed in the state where empty feeding is more likely to occur than multiple sheet feeding.

Next, operations of the paper feeding apparatus 1 of the fourth embodiment in the case where empty feeding has occurred will be described.

The operations of the paper feeding apparatus 1 of the fourth embodiment in the case where empty feeding has occurred are the same as the operations explained using the flowcharts of FIGS. 6 and 7 in the first embodiment, other than the processing in step S22 of FIG. 7.

In the fourth embodiment, the processing in step S22 of FIG. 7 where the following threshold value is increased by a prescribed amount is replaced by the processing where the suction force applied to a sheet P by the conveyor 8 is increased by the prescribed amount. That is, upon determining that the intermittent empty feeding count value Cb has reached the prescribed upper limit intermittent number D (step S21: YES), the controller 13 increases the suction force applied to a sheet P by the conveyor 8 by the prescribed amount.

Specifically, the controller 13 increases the suction air volume of the suction mechanism 25 by a prescribed air volume. Accordingly, it is possible to reduce the occurrences of subsequent empty feeding. How much the suction force applied to a sheet P by the conveyor 8 should be increased by, that is, how much (the prescribed air volume described above) the suction air volume of the suction mechanism 25 should be increased by, is set beforehand based on experimentation and the like, as a value with which the occurrences of empty feeding can be reduced.

As explained above, in the fourth embodiment, the controller 13 controls the conveyor 8 such that the suction force applied to a sheet P by the conveyor 8 becomes a suction force with which empty feeding of a sheet P is more likely to occur than multiple sheet feeding of sheets P during the following control. Thus, as with the first embodiment, it is possible to reduce the occurrences of multiple sheet feeding which cannot be remedied by a sheet feeding retry and result in a sheet feeding error. Although empty feeding becomes more likely to occur, the controller 13, upon empty feeding having occurred, performs (repeats) a sheet feeding retry until the number of occurrences of consecutive empty feeding reaches the prescribed upper limit consecutive number R. Thus, a sheet feeding error can be prevented even if empty feeding has occurred, by remedying empty feeding by means of a sheet feeding retry. As a result, sheet feeding errors can be reduced.

In the fourth embodiment, as with the first embodiment, upon the number of occurrences of consecutive empty feeding of a sheet P in the conveyor 8 (the consecutive empty feeding count value Ca) having reached the prescribed upper limit consecutive number R, the controller 13 completes a series of sheet feeding operations without performing a sheet feeding retry afterward. Thus, it is possible to prevent the unproductive repetition of empty feeding and a sheet feeding retry.

In the fourth embodiment, as with the first embodiment, upon empty feeding of a sheet P in the conveyor 8 having occurred in the period from the start of a series of sheet feeding operations to determination of the following threshold value, the controller 13 does not use a sensor value(s) sampled at the time of the occurrence of empty feeding, as a sensor value(s) for determining the following threshold value. Thus, it is possible to prevent a decrease in the accuracy of the following threshold value even if empty feeding has occurred before determination of the following threshold value.

In the fourth embodiment, as with the first embodiment, the controller 13 forcibly lifts the sheet feed tray 2 by the prescribed lifting amount upon empty feeding of a sheet P in the conveyor 8 having occurred during the following control. Thus, it is possible to prevent consecutive occurrences of empty feeding.

In the fourth embodiment, upon the number of occurrences of intermittent empty feeding of a sheet P in the conveyor 8 (the intermittent empty feeding count value Cb) having reached the prescribed upper limit intermittent number D during the following control, the controller 13 increases the suction force applied to a sheet P by the conveyor 8 by the prescribed amount. Thus, it is possible to improve the situation, if confronted therewith, where empty feeding is likely to occur due to the suction force applied to a sheet P by the conveyor 8 being too small.

In the fourth embodiment, as with the second embodiment, upon empty feeding of a sheet P in the conveyor 8 having occurred before determination of the following threshold value, the controller 13 may complete a series of sheet feeding operations without performing a sheet feeding retry. Thus, by determining a sheet feeding error at an earlier stage after the start of a sheet feeding operation, a user can respond at an earlier stage.

In the fourth embodiment, as with the third embodiment, the controller 13 may not forcibly lift the sheet feed tray 2 until empty feeding of a sheet P in the conveyor 8 during the following control has repeatedly occurred up to the prescribed consecutive number K. Thus, an increased risk of the occurrences of multiple sheet feeding due to the excessive lifting of the sheet feed tray 2 can be prevented and the occurrence of empty feeding can be prevented.

Upon determining that the intermittent empty feeding count value Cb has reached the prescribed upper limit intermittent number D, the controller 13 may increase the following threshold value by a prescribed amount as with the first embodiment. Furthermore, upon determining that the intermittent empty feeding count value Cb has reached the prescribed upper limit intermittent number D, the controller 13 may combine the processing of increasing the following threshold value by the prescribed amount and the processing of increasing the suction force applied to a sheet P by the conveyor 8 by the prescribed amount. In the case where the processing of increasing the following threshold value by the prescribed amount and the processing of increasing the suction force applied to a sheet P by the conveyor 8 by the prescribed amount are combined, how much the following threshold value should be increased by and how much the suction force applied to a sheet P by the conveyor 8 should be increased by can be set beforehand based on experimentation and the like, for example, such that the occurrences of empty feeding can be reduced.

Other Embodiments

In the first to fourth embodiments, the sampling period SP in the processing of determining the following threshold value is set such that the same number of sheets P are fed before and after the timing MT at which the height position of the upper surface of the sheet stack PT becomes the target position, and the average value of the sampled sensor values is determined as the following threshold value. However, the respective numbers of sheets P fed before and after the timing MT at which the height position of the upper surface of the sheet stack PT becomes the target position in the sampling period SP may be different from each other. In this case, the following threshold value can be determined by adjusting the average value of the sampled sensor values of the number of sampling sheets, depending on the respective numbers of sheets P fed before and after the timing MT at which the height position of the upper surface of the sheet stack PT becomes the target position in the sampling period SP, for example.

Moreover, if the behavior of floated sheets P even immediately after the start of a sheet feeding operation is stable, setting of the number of sampling exclusion sheets immediately after the start of a sheet feeding operation may be omitted and the sampling period SP may be started together with (at the same time with, for example) the start of a sheet feeding operation. For example, the sampling period SP may be started together with (at the same time with, for example) the start of a sheet feeding operation in the configuration where blowing air between sheets P of the sheet stack PT before the start of a sheet feeding operation can avoid plural sheets P floating with the plural sheets P being closely attached to each other and thus can stabilize the behavior of floated sheets P.

Moreover, as described above, if the behavior of floated sheets P even immediately after the start of a sheet feeding operation is stable, the sensor value sampled at the time of conveyance of the first sheet P in the sheet feed operation may be determined to be the following threshold value. In this case, the height position of the sheet feed tray 2 at the timing of the start of a sheet feeding operation is set such that the height position of the upper surface of the sheet stack PT becomes the target position during a sheet feeding operation. Then, a sensor value during the floating of sheets P floated for conveyance of the first sheet P in a sheet feeding operation is sampled, the sampled sensor value is determined to be the following threshold value, and the following control is started. The processing of determining the following threshold value may be a process where a sensor value(s) during the floating of sheets P floated by the floating unit 6 is sampled during conveyance of at least one sheet P after the start of a sheet feeding operation, and the following threshold value is determined by using the sampled sensor value(s).

In the first to fourth embodiments, the following threshold value is determined by sampling a sensor value(s) during the floating of sheets P after the start of a sheet feeding operation. However, the following control may be performed using a following threshold value set beforehand.

In the first to fourth embodiments, the upper limit sensor 9 is formed of an optical sensor. However, the upper limit sensor 9 is not limited to this and the upper limit sensor 9 may be a sensor which detects a sheet P using electromagnetic waves, infrared, or the like. The present invention stands as long as the upper limit sensor 9 is a sensor which detects an output signal acquired due to an input to the side of the sheet stack PT. Further, the present invention stands as long as the following control is control of acquiring a detection value of the upper limit sensor 9 during the floating of sheets P floated by the floating unit 6 each time a sheet P is conveyed by the conveyor 8 and lifting the sheet feed tray 2 upon the acquired detection value being less than a threshold value.

In the first to fourth embodiments, the conveyor 8 sucks a sheet P by air suction and conveys the sucked sheet P. However, the conveyor 8 is not limited to this and the conveyor 8 may suck a sheet P with a suction force generated by electrostatic force or magnetic force and convey the sucked sheet P.

In the first to fourth embodiments, a paper feeding apparatus which feeds sheets of paper is explained. However, the present invention can be also applied to an apparatus which feeds sheets other than paper.

Embodiments of the disclosure include, for example, the following configurations.

(Note 1)

A sheet feeding apparatus may include: a stacking tray on which a sheet stack is stacked and which is capable of lifting and lowering; a floating unit configured to blow air to the sheet stack to float sheets of the sheet stack; a conveyor configured to convey a top sheet of sheets floated by the floating unit, to a supply destination; a detector configured to detect an output signal acquired due to an input to a side of the sheet stack; and a controller configured to control the floating unit and the conveyor to convey a sheet to the supply destination, the controller being configured to perform a following control of acquiring a detection value of the detector during floating of sheets floated by the floating unit each time a sheet is conveyed by the conveyor and lifting the stacking tray upon the acquired detection value being less than a threshold value. The controller is configured to, upon an occurrence of empty feeding in the conveyor, control the floating unit and the conveyor to perform a feeding retry of performing sheet conveyance to the supply destination again. The controller is configured to determine the threshold value such that a target position for a height position of an upper surface of the sheet stack in the following control is a position where empty feeding is more likely to occur than multiple sheet feeding in the conveyor.

(Note 2)

In the sheet feeding apparatus according to Note 1, the detector may be configured to emit light toward the sheet stack from a position lateral to the sheet stack and receive light reflected from the sheet stack, and the detection value of the detector may be an amount of received light at the detector.

(Note 3)

In the sheet feeding apparatus according to Note 2, the controller may be configured to: sample amounts of received light at the detector during floating of sheets floated by the floating unit at a time of conveyance of at least one sheet, determine the threshold value by using the sampled amounts of received light, and start the following control; and upon an occurrence of empty feeding in the conveyor prior to a determination of the threshold value, not use an amount of received light sampled at a time of the occurrence of empty feeding as an amount of received light for determining the threshold value.

(Note 4)

In the sheet feeding apparatus according to Note 2, the controller may be configured to: sample amounts of received light at the detector during floating of sheets floated by the floating unit at a time of conveyance of at least one sheet, determine the threshold value by using the sampled amounts of received light, and start the following control; and upon an occurrence of empty feeding in the conveyor prior to a determination of the threshold value, complete a series of sheet feeding operations without performing the feeding retry.

(Note 5)

In the sheet feeding apparatus according to any one of Notes 2 to 4, upon a number of occurrences of intermittent empty feeding in the conveyor reaching a prescribed intermittent number during the following control, the controller may be configured to increase the threshold value by a prescribed amount.

(Note 6)

In the sheet feeding apparatus according to any one of Notes 2 to 4, the conveyor may be configured to convey a sheet while sucking the sheet, and upon a number of occurrences of intermittent empty feeding in the conveyor reaching a prescribed intermittent number during the following control, the controller may be configured to perform at least one of processing of increasing the threshold value by a prescribed amount or processing of increasing a sheet suction force of the conveyor by a prescribed amount.

(Note 7)

A sheet feeding apparatus may include: a stacking tray on which a sheet stack is stacked and which is capable of lifting and lowering; a floating unit configured to blow air to the sheet stack to float sheets of the sheet stack; a conveyor configured to suck and convey a top sheet of sheets floated by the floating unit, to a supply destination; and a controller configured to control the floating unit and the conveyor to convey a sheet to the supply destination, the controller being configured to perform a following control of lifting the stacking tray in response to a decrease in sheets on the stacking tray. The controller is configured to: upon an occurrence of empty feeding in the conveyor, control the floating unit and the conveyor to perform a feeding retry of performing sheet conveyance to the supply destination again; and control the conveyor such that a sheet suction force of the conveyor is a suction force with which empty feeding is more likely to occur than multiple sheet feeding in the conveyor when a height position of an upper surface of the sheet stack is at a target position in the following control.

(Note 8)

The sheet feeding apparatus according to Note 7 may further include a detector configured to emit light toward the sheet stack from a position lateral to the sheet stack and receive light reflected from the sheet stack. The controller may be configured to: perform, as the following control, control of acquiring an amount of received light at the detector during floating of sheets floated by the floating unit each time a sheet is conveyed by the conveyor and lifting the stacking tray upon the acquired amount of received light being less than a threshold value; prior to a start of the following control, sample amounts of received light at the detector during floating of sheets floated by the floating unit at a time of conveyance of at least one sheet, and determine the threshold value by using the sampled amounts of received light; and upon an occurrence of empty feeding in the conveyor prior to a determination of the threshold value, not use an amount of received light sampled at a time of the occurrence of empty feeding as an amount of received light for determining the threshold value.

(Note 9)

The sheet feeding apparatus according to Note 7 may further include a detector configured to emit light toward the sheet stack from a position lateral to the sheet stack and receive light reflected from the sheet stack. The controller may be configured to: perform, as the following control, control of acquiring an amount of received light at the detector during floating of sheets floated by the floating unit each time a sheet is conveyed by the conveyor and lifting the stacking tray upon the acquired amount of received light being less than a threshold value; prior to a start of the following control, sample amounts of received light at the detector during floating of sheets floated by the floating unit at a time of conveyance of at least one sheet, and determine the threshold value by using the sampled amounts of received light; and upon an occurrence of empty feeding in the conveyor prior to a determination of the threshold value, complete a series of sheet feeding operations without performing the feeding retry.

(Note 10)

The sheet feeding apparatus according to any one of Notes 7 to 9 may further include a detector configured to emit light toward the sheet stack from a position lateral to the sheet stack and receive light reflected from the sheet stack. The controller is configured to: perform, as the following control, control of acquiring an amount of received light at the detector during floating of sheets floated by the floating unit each time a sheet is conveyed by the conveyor and lifting the stacking tray upon the acquired amount of received light being less than a threshold value; and upon a number of occurrences of intermittent empty feeding in the conveyor reaching a prescribed intermittent number during the following control, perform at least one of processing of increasing the threshold value by a prescribed amount or processing of increasing the sheet suction force of the conveyor by a prescribed amount.

(Note 11)

In the sheet feeding apparatus according to any one of Notes 2 to 10, the controller may be configured to forcibly lift the stacking tray by a prescribed lifting amount upon an occurrence of empty feeding in the conveyor during the following control.

(Note 12)

In the sheet feeding apparatus according to Note 11, the controller may be configured not to forcibly lift the stacking tray until repetition of a prescribed plural number of times of an occurrence of empty feeding in the conveyor during the following control.

(Note 13)

In the sheet feeding apparatus according to any one of Notes 2 to 12, upon a number of occurrences of consecutive empty feeding in the conveyor reaching a prescribed number, the controller may be configured to complete a series of sheet feeding operations without performing the feeding retry afterward.

Embodiments of the present invention have been described above. However, the invention may be embodied in other specific forms without departing from the spirit or essential characteristics thereof. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiments of the present invention.

What is claimed is:

1. A sheet feeding apparatus comprising:

a stacking tray on which a sheet stack is stacked and which is capable of lifting and lowering;

a floating unit configured to blow air to the sheet stack to float sheets of the sheet stack;

a conveyor configured to convey a top sheet of sheets floated by the floating unit, to a supply destination;

a detector configured to detect an output signal acquired due to an input to a side of the sheet stack; and a controller configured to control the floating unit and the conveyor to convey a sheet to the supply destination, the controller being configured to perform a following control of acquiring a detection value of the detector during floating of sheets floated by the floating unit each time a sheet is conveyed by the conveyor and lifting the stacking tray upon the acquired detection value being less than a threshold value, wherein the controller is configured to upon an occurrence of empty feeding in the conveyor, control the floating unit and the conveyor to perform a feeding retry of performing sheet conveyance to the supply destination again, determine the threshold value such that a target position for a height position of an upper surface of the sheet stack in the following control is a position where empty feeding is more likely to occur than multiple sheet feeding in the conveyor, forcibly lift the stacking tray by a prescribed lifting amount upon an occurrence of empty feeding in the conveyor during the following control, and not to forcibly lift the stacking tray until repetition of a prescribed plural number of times of an occurrence of empty feeding in the conveyor during the following control.

2. The sheet feeding apparatus according to claim 1, wherein the detector is configured to emit light toward the sheet stack from a position lateral to the sheet stack and receive light reflected from the sheet stack, and the detection value of the detector is an amount of received light at the detector.

3. The sheet feeding apparatus according to claim 2, wherein the controller is configured to sample amounts of received light at the detector during floating of sheets floated by the floating unit at a time of conveyance of at least one sheet, determine the threshold value by using the sampled amounts of received light, and start the following control, and upon an occurrence of empty feeding in the conveyor prior to a determination of the threshold value, not use an amount of received light sampled at a time of the occurrence of empty feeding as an amount of received light for determining the threshold value.

4. The sheet feeding apparatus according to claim 2, wherein the controller is configured to sample amounts of received light at the detector during floating of sheets floated by the floating unit at a time of conveyance of at least one sheet, determine the threshold value by using the sampled amounts of received light, and start the following control, and upon an occurrence of empty feeding in the conveyor prior to a determination of the threshold value, complete a series of sheet feeding operations without performing the feeding retry.

5. The sheet feeding apparatus according to claim 2, wherein, upon a number of occurrences of intermittent empty feeding in the conveyor reaching a prescribed intermittent number during the following control, the controller is configured to increase the threshold value by a prescribed amount.

6. The sheet feeding apparatus according to claim 2, wherein the conveyor is configured to convey a sheet while sucking the sheet, and upon a number of occurrences of intermittent empty feeding in the conveyor reaching a prescribed intermittent number during the following control, the controller is configured to perform at least one of processing of increasing the threshold value by a prescribed amount or processing of increasing a sheet suction force of the conveyor by a prescribed amount.

7. The sheet feeding apparatus according to claim 2, wherein, upon a number of occurrences of consecutive empty feeding in the conveyor reaching a prescribed number, the controller is configured to complete a series of sheet feeding operations without performing the feeding retry afterward.

8. A sheet feeding apparatus comprising:

a stacking tray on which a sheet stack is stacked and which is capable of lifting and lowering;

a floating unit configured to blow air to the sheet stack to float sheets of the sheet stack;

a conveyor configured to suck and convey a top sheet of sheets floated by the floating unit, to a supply destination; and a controller configured to control the floating unit and the conveyor to convey a sheet to the supply destination, the controller being configured to perform a following control of lifting the stacking tray in response to a decrease in sheets on the stacking tray, wherein the controller is configured to upon an occurrence of empty feeding in the conveyor, control the floating unit and the conveyor to perform a feeding retry of performing sheet conveyance to the supply destination again, control the conveyor such that a sheet suction force of the conveyor is a suction force with which empty feeding is more likely to occur than multiple sheet feeding in the conveyor when a height position of an upper surface of the sheet stack is at a target position in the following control, forcibly lift the stacking tray by a prescribed lifting amount upon an occurrence of empty feeding in the conveyor during the following control, and not to forcibly lift the stacking tray until repetition of a prescribed plural number of times of an occurrence of empty feeding in the conveyor during the following control.

9. The sheet feeding apparatus according to claim 8, further comprising a detector configured to emit light toward the sheet stack from a position lateral to the sheet stack and receive light reflected from the sheet stack, wherein the controller is configured to perform, as the following control, control of acquiring an amount of received light at the detector during floating of sheets floated by the floating unit each time a sheet is conveyed by the conveyor and lifting the stacking tray upon the acquired amount of received light being less than a threshold value, prior to a start of the following control, sample amounts of received light at the detector during floating of sheets floated by the floating unit at a time of conveyance of at least one sheet, and determine the threshold value by using the sampled amounts of received light, and upon an occurrence of empty feeding in the conveyor prior to a determination of the threshold value, not use an amount of received light sampled at a time of the occurrence of empty feeding as an amount of received light for determining the threshold value.

10. The sheet feeding apparatus according to claim 8, further comprising a detector configured to emit light toward the sheet stack from a position lateral to the sheet stack and receive light reflected from the sheet stack, wherein the controller is configured to perform, as the following control, control of acquiring an amount of received light at the detector during floating of sheets floated by the floating unit each time a sheet is conveyed by the conveyor and lifting the stacking tray upon the acquired amount of received light being less than a threshold value, prior to a start of the following control, sample amounts of received light at the detector during floating of sheets floated by the floating unit at a time of conveyance of at least one sheet, and determine the threshold value by using the sampled amounts of received light, and upon an occurrence of empty feeding in the conveyor prior to a determination of the threshold value, complete a series of sheet feeding operations without performing the feeding retry.

11. The sheet feeding apparatus according to claim 8, further comprising a detector configured to emit light toward the sheet stack from a position lateral to the sheet stack and receive light reflected from the sheet stack, wherein the controller is configured to perform, as the following control, control of acquiring an amount of received light at the detector during floating of sheets floated by the floating unit each time a sheet is conveyed by the conveyor and lifting the stacking tray upon the acquired amount of received light being less than a threshold value, and upon a number of occurrences of intermittent empty feeding in the conveyor reaching a prescribed intermittent number during the following control, perform at least one of processing of increasing the threshold value by a prescribed amount or processing of increasing the sheet suction force of the conveyor by a prescribed amount.

12. The sheet feeding apparatus according to claim 8, wherein, upon a number of occurrences of consecutive empty feeding in the conveyor reaching a prescribed number, the controller is configured to complete a series of sheet feeding operations without performing the feeding retry afterward.

* * * * *